United States Patent [19]

Sato et al.

[11] Patent Number: 5,019,493

[45] Date of Patent: May 28, 1991

[54] SILVER HALIDE PHOTOGRAPHIC MATERIAL AND METHOD OF FORMING A DYE IMAGE THEREON

[75] Inventors: Hirokazu Sato; Shigeto Hirabayashi, both of Hino, Japan

[73] Assignee: Konishiroku Photo Industry Co., Ltd., Tokyo, Japan

[21] Appl. No.: 476,110

[22] Filed: Jan. 29, 1990

Related U.S. Application Data

[63] Continuation of Ser. No. 107,410, Oct. 13, 1987, abandoned.

[30] Foreign Application Priority Data

Oct. 13, 1986 [JP] Japan ..... 61-242785

[51] Int. Cl.[5] ..... G03C 7/32; G03C 7/34

[52] U.S. Cl. ..... 430/553; 430/359; 430/546; 430/551; 430/552

[58] Field of Search ..... 430/359, 546, 551, 552, 430/553, 555, 558, 377, 543

[56] References Cited

U.S. PATENT DOCUMENTS

| | | | |
|---|---|---|---|
| 2,353,262 | 7/1944 | Peterson et al. | 430/546 |
| 3,676,137 | 7/1972 | Mizuki et al. | 430/377 |
| 4,584,264 | 4/1986 | Ohki et al. | 430/551 |
| 4,973,535 | 11/1990 | Merkel | 430/546 |

FOREIGN PATENT DOCUMENTS

| | | |
|---|---|---|
| 65134 | 5/1981 | Japan . |
| 76543 | 5/1982 | Japan . |
| 179842 | 11/1982 | Japan . |
| 204543 | 12/1982 | Japan . |
| 204544 | 12/1982 | Japan . |
| 204545 | 12/1982 | Japan . |
| 1139 | 1/1983 | Japan . |
| 33249 | 2/1983 | Japan . |
| 33251 | 2/1983 | Japan . |
| 33252 | 11/1983 | Japan . |
| 139031 | 8/1984 | Japan . |
| 185335 | 10/1984 | Japan . |
| 0204041 | 11/1984 | Japan . |
| 222853 | 11/1985 | Japan . |
| 225155 | 11/1985 | Japan . |
| 20589 | 1/1986 | Japan . |

*Primary Examiner*—Richard L. Schilling

*Attorney, Agent, or Firm*—Finnegan, Henderson, Farabow, Garrett, and Dunner

[57] ABSTRACT

A silver halide photographic material that has at least one silver halide emulsion layer containing a phenolic cyan coupler of the general formula (I) and an amine of the general formula (II). The maximum absorption of the dye formed in sufficiently shifted to a longer wavelength range of the spectrum to achieve satisfactory color reproduction. The dye image produced has a high maximum density and improved keeping quality.

4 Claims, No Drawings

SILVER HALIDE PHOTOGRAPHIC MATERIAL AND METHOD OF FORMING A DYE IMAGE THEREON

This application is a continuation of application Ser. No. 07/107,410, filed Oct. 13, 1987, now abandoned.

BACKGROUND OF THE INVENTION

The present invention relates to a silver halide photographic material that produces a dye image affording improved color reproduction and image keeping quality, as well as high maximum density.

To conventional cyan couplers that have high resistance to fading in the dark and which are used in photographic materials for direct viewing such as color papers are 2,5-diacylamino based cyan couplers and phenolic cyan couplers that have an alkyl group with 2 or more carbon atoms at the 5-position. However, the dyes formed from 2,5-diacylamino based cyan couplers have a maximum absorption peak in the shorter wavelength range than those obtained from commonly employed phenolic cyan couplers that do not have any acylamino group at the 5-position, and because of the large magenta color component that results from the absorption at the tail of the short-wavelength side of the absorption spectrum, it is difficult to achieve satisfactory reproduction of a brilliant green color. The phenolic cyan couplers that have an alkyl group with 2 or more carbon atoms at the 5-position also have the disadvantage that the dyes formed from such couplers have a large yellow component near 420 nm that prevents satisfactory reproduction of a brilliant blue color.

With the recent concern over environmental pollution and the need to keep a good working condition, it has become desirable to use color developing solutions that do not contain any benzyl alcohol that works as an accelerator of color formation. One problem with this approach is that if a silver halide color photographic material that employs a 2,5-diacylamino based cyan coupler or a phenolic cyan coupler that has an alkyl group with 2 or more carbon atoms at the 5-position is processed with a benzyl alcohol free color developer, the resulting color density is insufficient to attain a desired maximum value.

Cyan couplers suitable for use in high-sensitivity imaging silver halide color photographic materials are known and they are the phenolic cyan couplers that have a ureido group at the 2-position of the phenolic nucleus as shown in Japanese Patent Application (OPI) Nos. 65134/1981, 204543/1982, 204544/1982, 204545/1982, 33249/1983, 33251/1983 and 33252/1983 (the term OPI as used herein means an unexamined published Japanese patent application). Such phenolic cyan couplers are superior to the conventional naphtholic cyan couplers in that the resulting cyan dyes will not experience fading by reduction in the bleaching or bleach-fixing step. Furthermore, the maximum absorption of the resulting dyes occurs in the shorter wavelength range of the spectrum than that of the dyes formed by the conventional naphtholic cyan couplers.

It has therefore been desired to develop a silver halide photographic material that employs a cyan coupler capable of forming a durable cyan dye image (i.e., a cyan dye image having improved resistance to fading either in the dark or by reduction) and which provides improved color reproduction due to improvement in the spectral absorption characteristics of the cyan dye and which has the additional advantage that a satisfactory color density can be attained by color development with a benzyl alcohol free color developing solution.

SUMMARY OF THE INVENTION

An object, therefore, of the present invention is to provide a silver halide photographic material that produces good color reproduction of a cyan dye image since it has a maximum absorption peak at the desired longer-wavelength side of the red spectral region.

A second object of the present invention is to provide a silver halide photographic material that produces a cyan dye image having improved keeping quality.

A third object of the present invention is to provide a silver halide photographic material that is capable of producing a dye image having a sufficiently high color density to attain a desired maximum level.

A fourth object of the present invention is to provide a method of forming a dye image, said dye having the maximum absorption in a longer wavelength range of the spectrum than in the case of the dye formed by the cyan coupler alone.

These objects of the present invention can be attained by a silver halide photographic material that has one or more silver halide emulsion layers on a support and which is characterized in that at least one of said silver halide emulsion layers contains at least one cyan coupler represented by the following general formula (I) and at least one non-color forming compound alone represented by the following general formula (II) and a method of forming a dye image by first performing imagewise exposure on a silver halide photographic material that has formed on a support one or more silver halide emulsion layers containing at least one cyan coupler represented by the following general formula (I) and then subjecting the exposed photographic material to color development and subsequent processing, wherein said silver halide emulsion layer containing the cyan coupler further contains a non-color forming compound represented by the following general formula (II) which is added to obtain an image forming dye having the maximum absorption in a longer wavelength range of the spectrum than in the case of the dye formed by said cyan coupler alone:

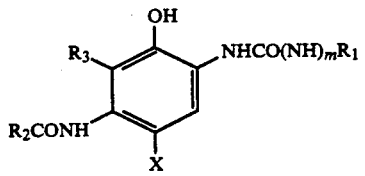

(I)

(where $R_1$ and $R_2$ are each an alkyl group, a cycloalkyl group, an alkenyl group, an aryl group or a heterocyclic group; $R_3$ is a hydrogen atom, a halogen atom, an alkyl group or an alkoxy group, provided that $R_2$ and $R_3$ may cooperate to form a ring; X is a hydrogen atom or a group that is capable of being eliminated upon reaction with the oxidation product of a color developing agent; m is 0 or 1);

$$R_4—NH—R_5 \quad \text{(II)}$$

(where $R_4$ and $R_5$ are each a hydrogen atom or a monovalent organic group, provided that at least one of $R_4$ and $R_5$ is an electron attractive group selected from among —CN, —$CSR_6$, —$SO_2R_7$ and —$SOR_8$ (where $R_6$, $R_7$ and $R_8$ are each a monovalent group, said monovalent group denoted by $R_7$ not including the groups which contain a nitrogen atom and bond to —$SO_2$— through said nitrogen atom), $R_7$ not including an alkyl group when one of said $R_4$ and $R_5$ is an aryl group and that $R_4$ and $R_5$ may be the same or different and may combine to form a ring together with —NH—).

DETAILED DESCRIPTION OF THE INVENTION

Referring to the cyan coupler having the general formula (I) (this cyan coupler is hereinafter referred to as the "cyan coupler of the present invention"), examples of the alkyl group denoted by $R_1$ or $R_2$ include those having 1–32 carbon atoms; examples of the alkenyl group denoted by $R_1$ or $R_2$ include those having 2–32 carbon atoms; and examples of the cycloalkyl group denoted by $R_1$ or $R_2$ include those having 3–12 carbon atoms. The alkyl and alkenyl groups may be straight-chained or branched. These alkyl alkenyl and cycloalkyl groups may have suitable substituents.

A preferred example of the aryl group denoted by $R_1$ or $R_2$ is a phenyl group, which may have a suitable substituent.

Preferred examples of the heterocyclic group denoted by $R_1$ or $R_2$ are those which are 5- to 7-membered and may include substituted or condensed heterocyclic groups.

In formula (I), $R_3$ signifies a hydrogen atom, a halogen atom, an alkyl group or an alkoxy group, with a hydrogen atom being preferred.

The ring that is formed by cooperation between $R_2$ and $R_3$ is preferably 5- or 6-membered and illustrative examples of the 5- or 6-membered ring formed include:

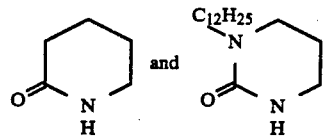

In formula (I), X signifies a group that is capable of being eliminated upon reaction with the oxidation product of a color developing agent and illustrative examples include a halogen atom, an alkoxy group, an aryloxy group, an acyloxy group, a sulfonyloxy group, an acylamino group, a sulfonylamino group, an alkoxycarbonyloxy group, an aryloxycarbonyloxy group or an imido group, among which a halogen atom, an aryloxy group and an alkoxy group are preferred.

Particularly preferred examples of the cyan coupler of the present invention are represented by the following general formula (I-A):

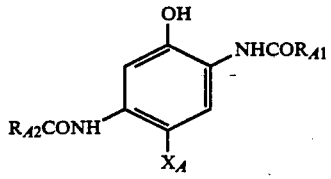

(I-A)

where $R_{A1}$ is a phenyl group substituted by at least one halogen atom, said phenyl group optionally having a substituent other than a halogen atom; $R_{A2}$ has the same meaning as $R_2$ in formula (I); and $X_A$ is a halogen atom, an aryloxy group or an alkoxy group.

A preferred example of $R_{A1}$ is a phenyl group substituted by 2–5 halogen atoms.

Typical examples of the cyan coupler represented by formula (I) are listed below.

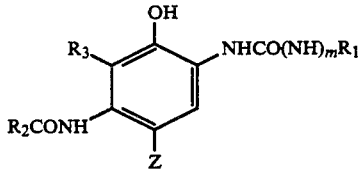

| Compound NO | $R_1$ | $R_2$ | $R_3$ | X | m |
|---|---|---|---|---|---|
| C-1 | —$(CF_2)_4H$ | 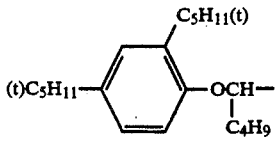 | —H | —Cl | 0 |
| C-2 | 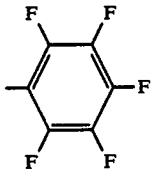 | 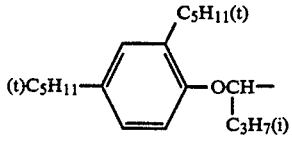 | —H | —Cl | 0 |

-continued
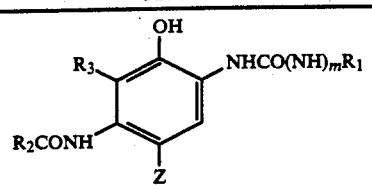
| Compound NO | $R_1$ | $R_2$ | $R_3$ | X | m |
|---|---|---|---|---|---|
| C-3 | 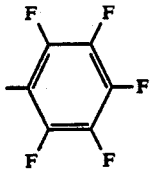 | 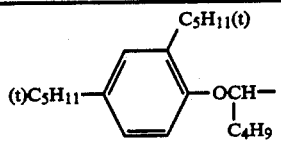 | —H | —Cl | 0 |
| C-4 | 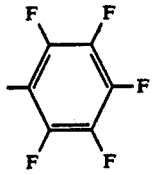 | $C_{16}H_{33}$— | —H | —Cl | 0 |
| C-5 | 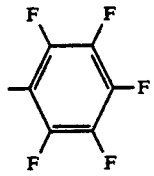 | 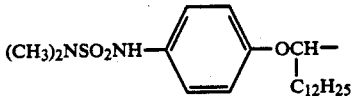 | —H | 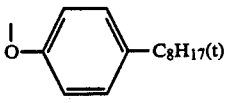 | 0 |
| C-6 | 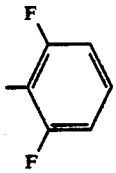 | 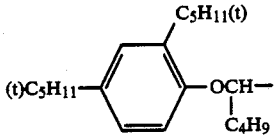 | —H | —H | 0 |
| C-7 | 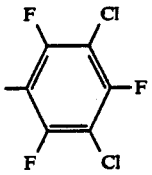 | 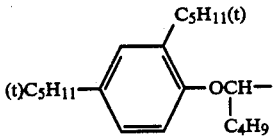 | —H | —Cl | 0 |
| C-8 | 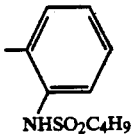 | 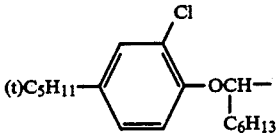 | —H | —Cl | 0 |
| C-9 | 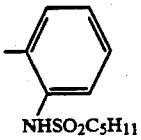 | 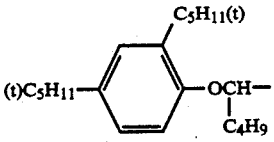 | —H | 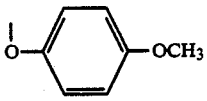 | 0 |
| C-10 | 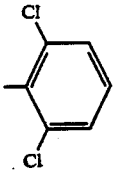 | 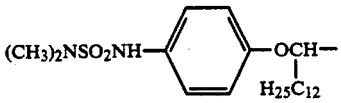 | —H | —Cl | 0 |

-continued
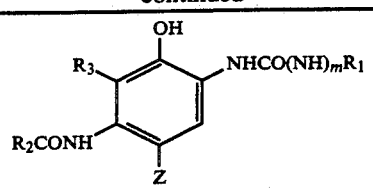
| Compound NO | $R_1$ | $R_2$ | $R_3$ | X | m |
|---|---|---|---|---|---|
| C-11 | 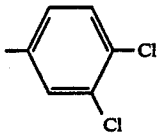 | 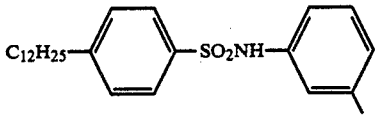 | —H | —Cl | 0 |
| C-12 | 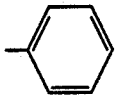 | 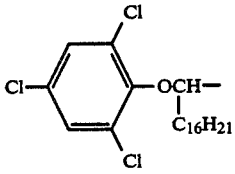 | —H | —$OCH_2CONHC_3H_7$ | 0 |
| C-13 | 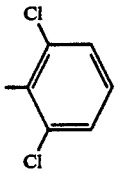 | 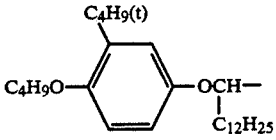 | —H | —Cl | 0 |
| C-14 | 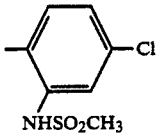 | 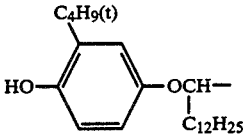 | —H | —Cl | 0 |
| C-15 | 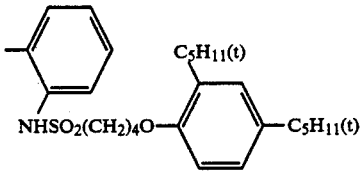 | 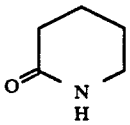 | | —Cl | 0 |
| C-16 | 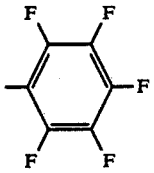 | 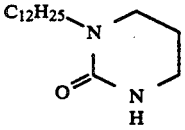 | | —Cl | 0 |
| C-17 | 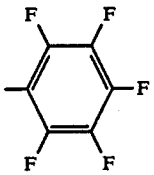 | 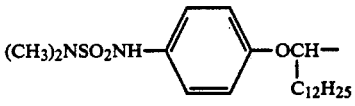 | —H | —Cl | 0 |
| C-18 | 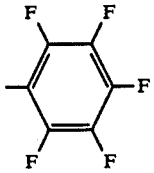 | 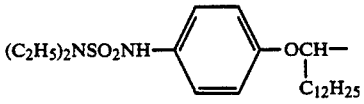 | —H | —Cl | 0 |

-continued
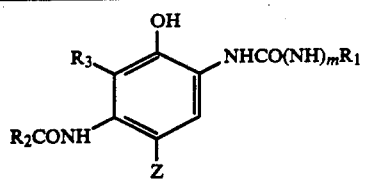
| Compound NO | $R_1$ | $R_2$ | $R_3$ | X | m |
|---|---|---|---|---|---|
| C-19 | 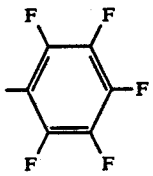 | 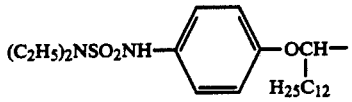 | —H | 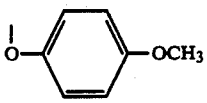 | 0 |
| C-20 | 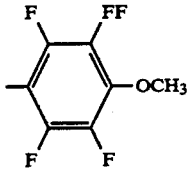 | 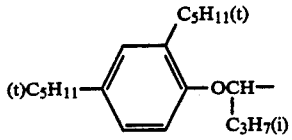 | —H | —Cl | 0 |
| C-21 | 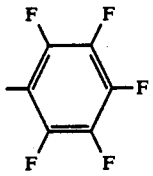 | 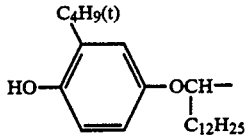 | —H | —Cl | 0 |
| C-22 | 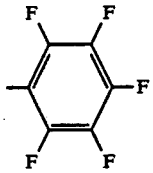 | 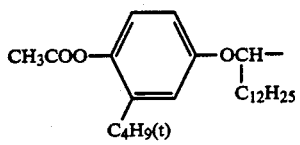 | —H | —Cl | 0 |
| C-23 | 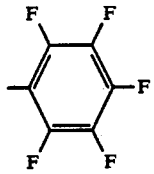 | 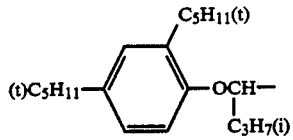 | —H | 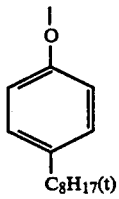 | 0 |
| C-24 | 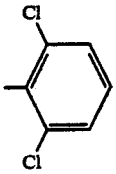 | 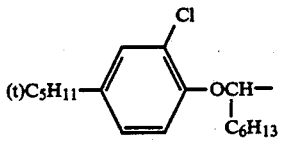 | —H | —Cl | 0 |
| C-25 | 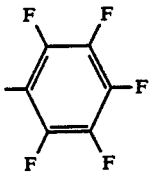 | 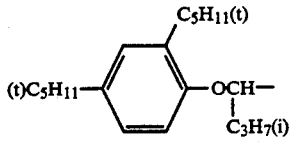 | —H | $OCH_2CONHCH_2CH_2OCH_3$ | 0 |

-continued

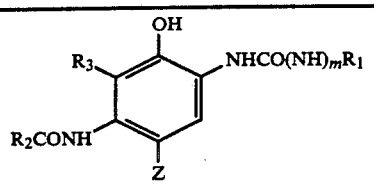

| Compound NO | $R_1$ | $R_2$ | $R_3$ | X | m |
|---|---|---|---|---|---|
| C-26 | 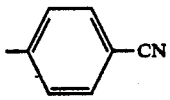 | 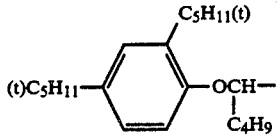 | —H | —H | 1 |
| C-27 | 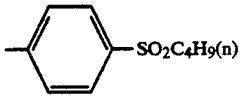 | 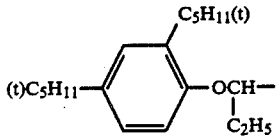 | —H | —H | 1 |
| C-28 | 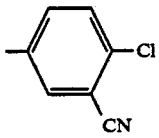 | 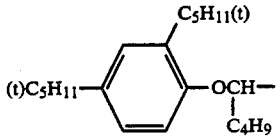 | —H | —H | 1 |
| C-29 | 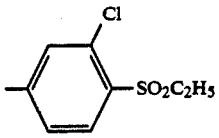 | 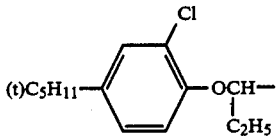 | —H | —Cl | 1 |
| C-30 | 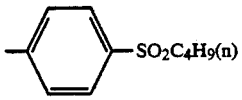 | 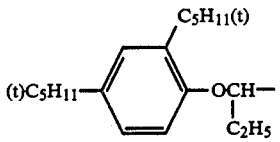 | —H | $OCH_2CONH(CH_2)_2OCH_3$ | 1 |
| C-31 | 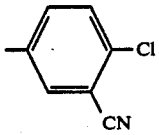 | 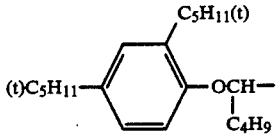 | —H | 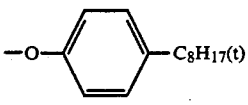 | 1 |

The cyan couplers of the present invention may include those which are described on pages 26–35 of the specification of Japanese Patent Application No. 21853/1986, on pages 25–38 of the specification of Japanese Patent Application (OPI) No. 225155/1985, on pages 19–30 of the specification of Japanese Patent Application (OPI) No. 222853/1985, on pages 21–30 of the specification of Japanese Patent Application (OPI) No. 185335/1984, and on pages 28–40 of the specification of Japanese Patent Application (OPI) No. 139031/1984. These couplers can be synthesized by the methods described in the specifications of the above-listed applications.

The cyan coupler of the present invention is incorporated in a silver halide emulsion layer, in particular, a red-sensitive emulsion layer, in an amount of from $2\times10^{-3}$ to $8\times10^{-1}$ mole, preferably from $1\times10^{-2}$ to $5\times10^{-1}$ mole, per mole of the silver halide.

We now describe the non-color forming compound that is represented by the general formula (II) and which is to be used in combination with the cyan coupler of the present invention (this non-color forming compound is hereinafter referred to as the "non-color forming compound of the present invention").

Examples of the monovalent organic group denoted by $R_4$ or $R_5$ in formula (II) include an alkyl group, a cycloalkyl group, an alkenyl group, a cycloalkenyl group, an alkynyl group, an aryl group, a heterocyclic group, an alkoxy group, an aryloxy group, a heterocyclic oxy group, an alkylamino group, an arylamino group, and a formyl group.

Examples of the alkyl group as the monovalent organic group signified by $R_4$ or $R_5$ include those which have 1–32 carbon atoms; examples of the alkenyl and alkynyl groups as the monovalent group include those having 2–32 carbon atoms; and examples of the cycloalkyl and cycloalkenyl groups include those having 3–12 carbon atoms. These alkyl, alkenyl and alkynyl group may be straight-chained or branched; they may optionally have suitable substituents.

A preferred example of the aryl group as the monovalent organic group is a phenyl group, which may optionally have a suitable substituent.

Preferred examples of the heterocyclic group as the monovalent organic group are those which are 5- to 7-membered and may include substituted or condensed heterocyclic groups.

Alkoxy groups useful as the monovalent organic group include those which are substituted, such as 2-ethoxyethoxy, pentadecyloxy, 2-dodecyloxyethoxy, and phenethyloxyethoxy.

A preferred example of the aryloxy group as the monovalent organic group is a phenoxy group, wherein the aryl nucleus may be substituented. Illustrative examples include phenoxy, p-t-butylphenoxy, and m-pentadecylphenoxy.

Preferred examples of the heterocyclic oxy group as the monovalent organic group include those having 5- to 7-membered hetero rings, which may be further substituted. Illustrative examples are 3, 4, 5, 6-tetrahydropyranyl-2-oxy, and 1-phenyltetrazol-5-oxy.

The alkylamino and arylamino groups as the monovalent organic group may have substituents, and more specific examples include diethylamino, anilino, p-chloroanilino, dodecylamino, and 2-methyl-4-cyanoanilino.

At least one of the groups denoted by $R_4$ and $R_5$ in formula (II) must be an electron attractive group. The term "electron attractive group" as used herein means an atomic group that withdraws electrons from a group of interest by the resonance or induction effect, and electron attractive groups generally assume positive Hammett ($\sigma_p$) values. The electron attractive group is selected from among —CN, —$CSR_6$, —$SO_2R_7$ and —$SOR_8$, wherein $R_6$ to $R_8$ are each a monovalent organic group such as an alkyl group, a cycloalkyl group, an alkenyl group, a cycloalkenyl group, an alkynyl group, an aryl group, a heterocyclic group, an alkoxy group, an aryloxy group, a heterocyclic oxy group, an alkylamino group, and an arylamino group, said monovalent group denoted by $R_7$ not including the groups which contain a nitrogen atom and bond to —$SO_2$— through the nitrogen atom. When one of said $R_4$ and $R_5$ is an aryl group, $R_7$ does not include an alkyl group.

Needless to say, both of $R_4$ and $R_5$ in formula (II) may be an electron attractive group.

More preferred examples of the non-color forming compound of the present invention are represented by the following general formula (III):

$$R_9—NHSO_2—R_{10} \quad \text{(III)}$$

where $R_9$ and $R_{10}$ are each a hydrogen atom, an alkyl group, a cycloalkyl group, an alkenyl group, a cycloalkenyl group, an alkynyl group, an aryl group, a heterocyclic group, an alkoxy group, an aryloxy group or a heterocyclicoxy group, provided that $R_9$ and $R_{10}$ may be the same or different.

Examples of the alkyl group, cycloakkyl group, alkenyl group, cycloalkenyl group, alkynyl group, aryl group, heterocyclic group, alkoxy group, aryloxy group and heterocyclic oxy group as signified by $R_9$ or $R_{10}$ may be the same as those listed for the alkyl group, cycloalkyl group, alkenyl group, cycloalkenyl group, alkynyl group, aryl group, heterocyclic group, alkoxy group, aryloxy group, heterocyclic oxy group, alkylamino group and arylamino group as denoted by $R_4$, $R_5$ and $R_6$–$R_8$ in formula (II).

Particularly preferred examples of the non-color forming compound of the present invention are represented by the following general formula (IV):

$$R_{11}—NHSO_2—R_{12} \quad \text{(IV)}$$

where $R_{11}$ and $R_{12}$ are each an optionally substituted alkyl or aryl group. Preferably, both $R_{11}$ and $R_{12}$ are an aryl group, both $R_{11}$ and $R_{12}$ are an alkyl group, or $R_{11}$ is alkyl group and $R_{12}$ is aryl group; and most preferably, both $R_{11}$ and $R_{12}$ are a phenyl group. If $R_{11}$ is a phenyl group, it is particularly preferable that the substituent on the position para to the sulfonamido group has a Hammett ($\sigma_p$) value of no smaller than −0.4.

The alkyl and aryl groups denoted by $R_{11}$ or $R_{12}$ have the same meanings as defined for the alkyl and aryl groups denoted by $R_9$ or $R_{10}$ in formula (III).

The non-color forming compound of the present invention may form a dimer or a higher oligomer at $R_4$ or $R_5$; $R_4$ and $R_5$ may combine to form a 5- or 6-membered ring.

The non-color forming compound of the present invention preferably contains at least 8, more preferably at least 12, carbon atoms in total.

Typical examples of the non-color forming compound of the present invention are listed below.

| Compound NO | $R_9$—$NHSO_2$—$R_{10}$ | |
|---|---|---|
| | $R_9$ | $R_{10}$ |
| A-1 | 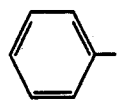 | 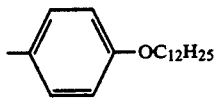 |
| A-2 | 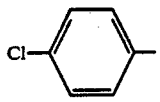 | 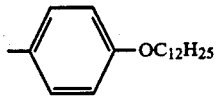 |
| A-3 | 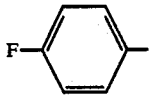 | 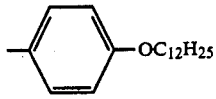 |

-continued
$R_9—NHSO_2—R_{10}$
| Compound NO | $R_9$ | $R_{10}$ |
|---|---|---|
| A-4 | 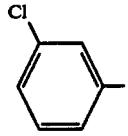 | 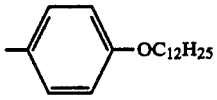 |
| A-5 | 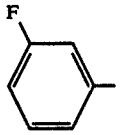 | 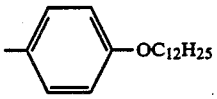 |
| A-6 | 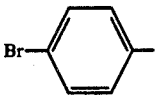 | 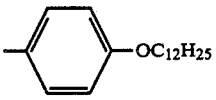 |
| A-7 | 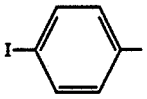 | 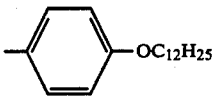 |
| A-8 | 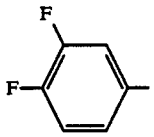 | 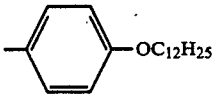 |
| A-9 | 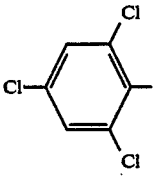 | 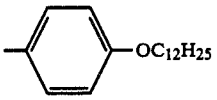 |
| A-10 | 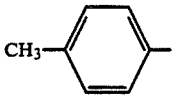 | 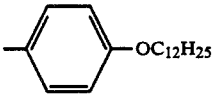 |
| A-11 | 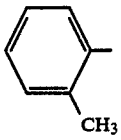 | 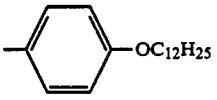 |
| A-12 | 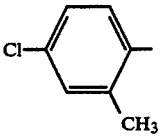 | 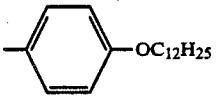 |
| A-13 | 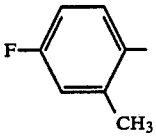 | 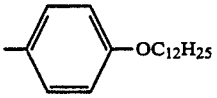 |

-continued
$R_9—NHSO_2—R_{10}$
| Compound NO | $R_9$ | $R_{10}$ |
|---|---|---|
| A-14 | 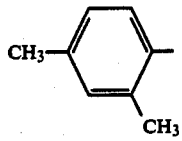 | 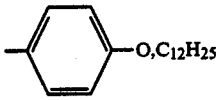 |
| A-15 | 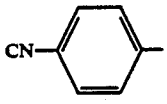 | 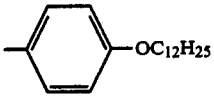 |
| A-16 | 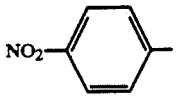 | 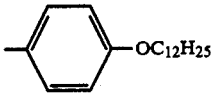 |
| A-17 | 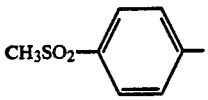 | 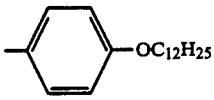 |
| A-18 | 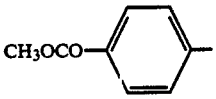 | 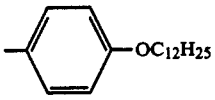 |
| A-19 | 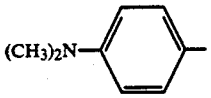 | 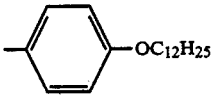 |
| A-20 | 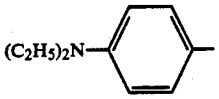 | 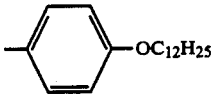 |
| A-21 | 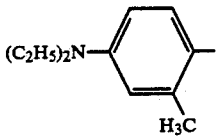 | 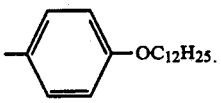 |
| A-22 | 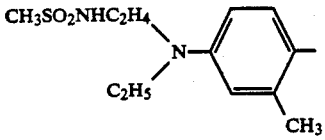 | 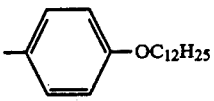 |
| A-23 | 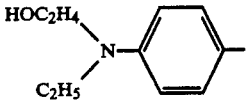 | 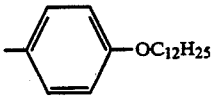 |
| A-24 | 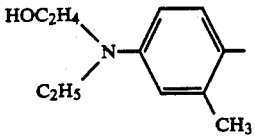 | 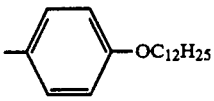 |

-continued
$R_9—NHSO_2—R_{10}$
| Compound NO | $R_9$ | $R_{10}$ |
|---|---|---|
| A-25 | 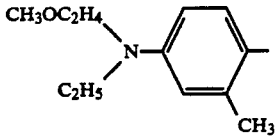 | 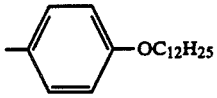 |
| A-26 | 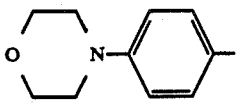 | 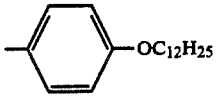 |
| A-27 | 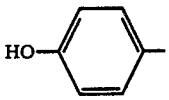 | 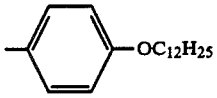 |
| A-28 | 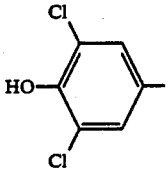 | 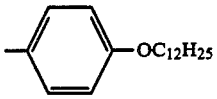 |
| A-29 | 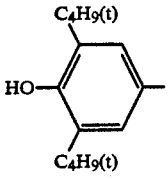 | 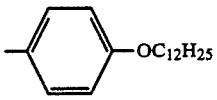 |
| A-30 | 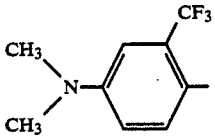 | 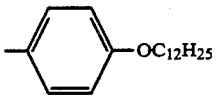 |
| A-31 | 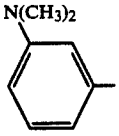 | 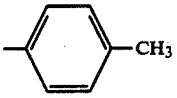 |
| A-32 | 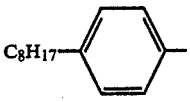 | 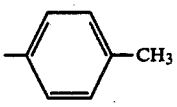 |
| A-33 | 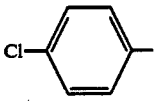 | 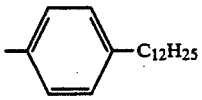 |
| A-34 | 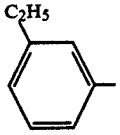 | 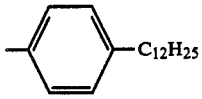 |

-continued
$R_9—NHSO_2—R_{10}$
| Compound NO | $R_9$ | $R_{10}$ |
|---|---|---|
| A-35 | 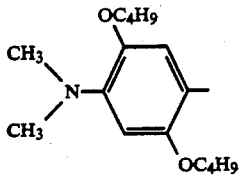 | 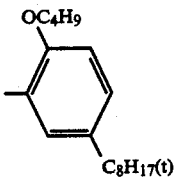 |
| A-36 | 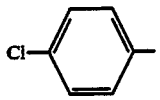 | 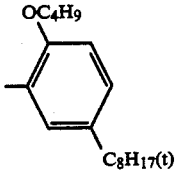 |
| A-37 | 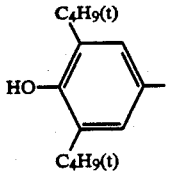 | 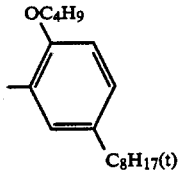 |
| A-38 | 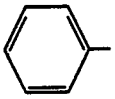 | 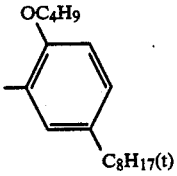 |
| A-39 | 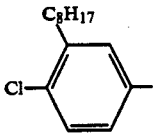 | 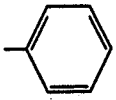 |
| A-40 | 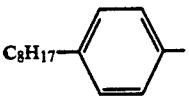 | 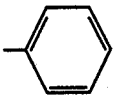 |
| A-41 | 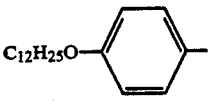 | 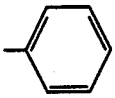 |
| A-42 | 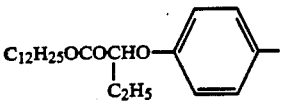 | 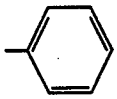 |
| A-43 | 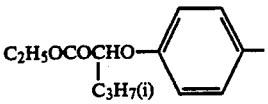 | 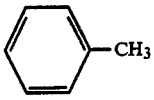 |
| A-44 | 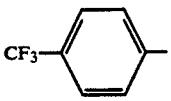 | 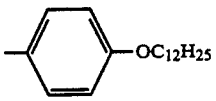 |

-continued $R_9—NHSO_2—R_{10}$

| Compound NO | $R_9$ | $R_{10}$ |
|---|---|---|
| A-45 | $C_5H_{11}$— | —$C_5H_{11}$ |
| A-46 | | —$OC_{12}H_{25}$ |
| A-47 | $CH_3CO$— | —$OC_{12}H_{25}$ |
| A-48 | $CH_3O$— | —$OC_{12}H_{25}$ |
| A-49 | $C_8H_{17}$— | |
| A-50 | $C_4H_9CH(C_2H_5)CH_2$— | |
| A-51 | —$CH_3$ | —$OC_{12}H_{25}$ |
| A-52 | $Cl(CH_2)_2$— | —$OC_{12}H_{25}$ |
| A-53 | $CF_3CH_2$— | $OC_4H_9$, $C_8H_{17}(t)$ |
| A-54 | —$CH_2$— | $OC_4H_9$, $C_8H_{17}(t)$ |
| A-55 | $C_8H_{17}$— | —$CH_3$ |

-continued
$R_9—NHSO_2—R_{10}$
| Compound NO | $R_9$ | $R_{10}$ |
|---|---|---|
| A-56 | $C_{12}H_{25}$— | 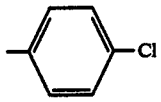 |
| A-57 | $C_8H_{17}$— | —$C(CH_3)_3$ |
| A-58 | $CCl_3CH_2$— | —$C_{16}H_{33}$ |
| A-59 | H— | 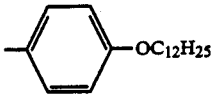 |
| A-60 | 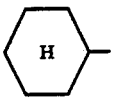 | 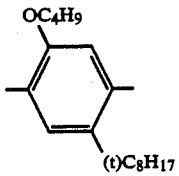 |
| A-61 | $CF_3CH{=}CH$— | 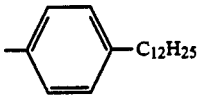 |
| A-62 | 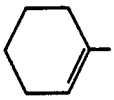 | 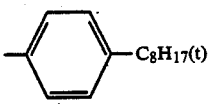 |
| A-63 | $HOCH_2CH_2C{\equiv}C$— | 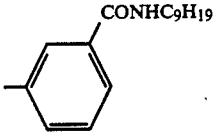 |
| A-64 | 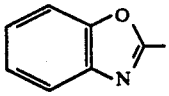 | —$C_{18}H_{37}$ |
| A-65 | 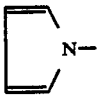 | 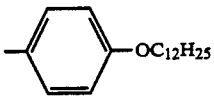 |
| A-66 | $C_4H_9CO$— | 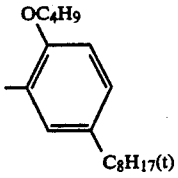 |
| A-67 | $C_{10}H_{21}NHCO$— | 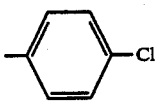 |
| A-68 | 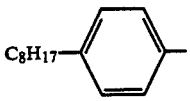 | —$OC_2H_5$ |

-continued
| Compound NO | $R_9$—$NHSO_2$—$R_{10}$ | |
|---|---|---|
| | $R_9$ | $R_{10}$ |
| A-69 | 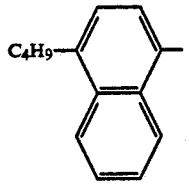 | 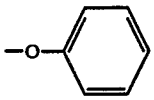 |
| A-70 | 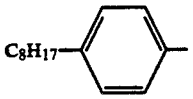 | 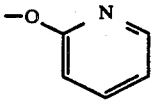 |
| A-71 | 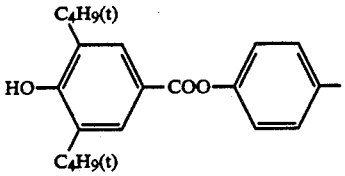 | 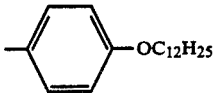 |
| A-72 | 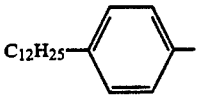 | 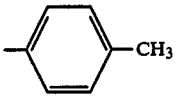 |
| A-73 | 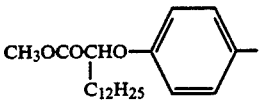 | 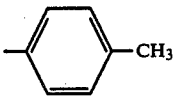 |
| A-74 | 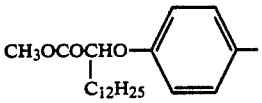 | 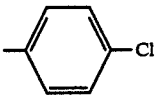 |
| A-75 | 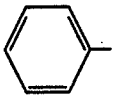 | 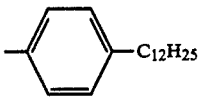 |
| A-76 | 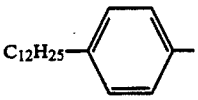 | 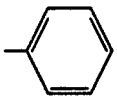 |
| A-77 | 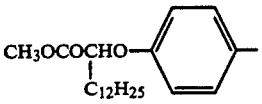 | 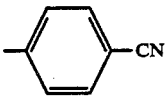 |
| A-78 | 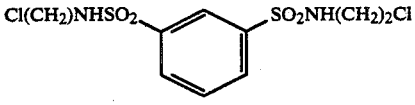 | |
| A-79 | 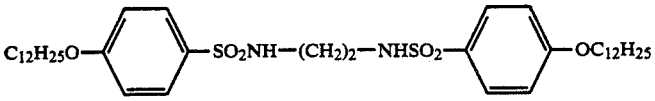 | |
| A-80 | 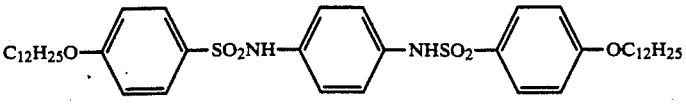 | |

-continued

| Compound NO | $R_9$—$NHSO_2$—$R_{10}$ | |
|---|---|---|
| | $R_9$ | $R_{10}$ |
| A-81 | 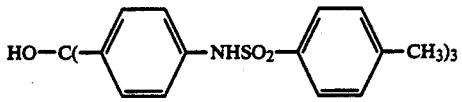 | |
| A-82 | 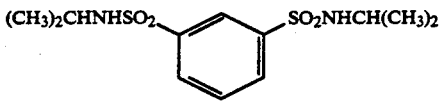 | |
| A-83 | 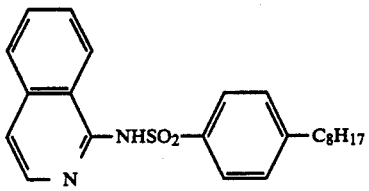 | |
| A-84 | 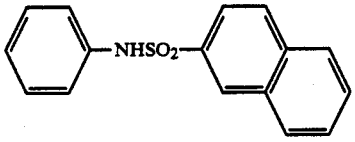 | |
| A-85 | 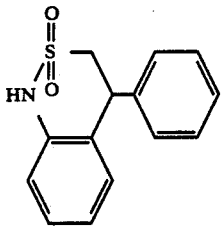 | |
| A-86 | 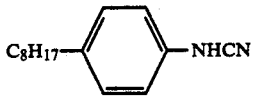 | |
| A-87 | 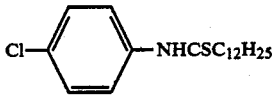 | |
| A-88 | 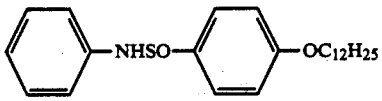 | |

The non-color forming compounds of the present invention can be synthesized by the method described in Japanese Patent Application No. 20589/1986 or by any known method.

The non-color forming compound of the present invention is used in an amount that preferably ranges from 5 to 500 mol %, more preferably from 10 to 300 mol %, of the cyan coupler of the present invention.

Part of the non-color forming compounds of the present invention are shown in Japanese Patent Application (OPI) Nos. 76543/1982, 179842/1982, 1139/1983 and Japanese Patent Application No. 20589/1986. However, these prior patents suggest nothing about the fact that the non-color forming compounds of the present invention achieves improved color reproduction by shifting the maximum absorption peak of cyan dyes to the longer wavelength side of the spectrum.

As a result of intensive studies conducted in this respect, the present inventors found that the maximum absorption peak of the cyan dye produced from the cyan coupler of the present invention was shifted by the non-color forming compound of the present invention to the longer-wavelength side of the spectrum so as to attain a significant improvement in color reproduction. This effect was first obtained by the present invention. While the present inventors do want to limited by any theory, it is speculated that an electron attractive group adjacent to —NH— in the non-color forming compound of the present invention will provide increased proton donation and establish hydrogen bonding with the cyan dye formed from the cyan coupler of the present invention, thereby shifting the absorption peak of the dye to the longer-wavelength side of the spectrum.

The cyan coupler of the present invention and the non-color forming compound of the present invention are incorporated in the same layer. Preferably, the coupler and the non-color forming compound are dissolved in a high boiling-point (≧150° C.) organic solvent, optionally in combination with a low boiling-point and/or a water soluble organic solvent, and the resulting solution is emulsified in a hydrophilic colloid, such as an aqueous gelatin solution, in the presence of a surfactant so as to prepare a dispersion which is to be incorporated in a desired hydrophilic colloidal layer.

Acylacetanilide based couplers are preferably employed in the present invention as yellow dye forming couplers. Advantageous acylacetanilide based couplers are benzoylacetanilide and pivaloylacetanilide compounds.

Known 5-pyrazolone, pyrazolotriazole and other pyrazoloazole based couplers are preferably used in the present invention as magenta couplers.

The cyan coupler of the present invention may be used in combination with known cyan dye forming couplers in amounts that will not impair the objects of the present invention. If the cyan coupler of the present invention is such that m in its formula (I) is zero, it is preferably combined with a cyan dye forming coupler represented by the following general formula (F):

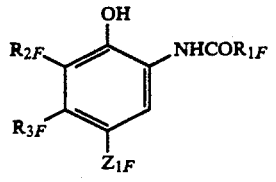

(F)

where $R_{1F}$ is a ballast group; $R_{2F}$ is a hydrogen atom, a halogen atom or an alkyl group; $R_{3F}$ is an alkyl group having 1-6 carbon atoms; $Z_{1F}$ is a hydrogen atom or a group that is capable of being eliminated upon reaction with the oxidation product of an aromatic primary amino based color developing agent.

Examples of such cyan dye forming couplers are shown in prior patents, e.g., Japanese Patent Application (OPI) Nos. 37425/1972, 10135/1975, 25228/1975, 112038/1975, 117422/1975, 130441/1975, U.S. Pat. Nos. 2,369,929, 2,423,730, 2,434,272, 2,474,293, 2,698,794, 2,895,826, Japanese Patent Application (OPI) Nos. 112038/1975, 109630/1978, 163537/1980, and U.S. Pat. Nos. 3,772,002 and 4,443,536.

If the cyan coupler of the present invention is such that m in its formula (I) is one, it is preferably combined with a naphtholic cyan dye forming coupler.

Any of the silver halides such as silver chloride, silver bromide, silver iodide, silver chlorobromide, silver iodobromide, and silver chloroiodide may be employed in the silver halide emulsions in the photographic material of the present invention.

The silver halides in silver halide photographic materials such as color papers that are required to feature a particularly high speed of development preferably contain chlorine atoms and it is particularly preferred to employ silver chlorobromide or silver chloroiodobromide each containing at least 1 mol % of silver chloride. These silver halides may be in the form of a polydispersed emulsion having a broad distribution of average grain sizes but a monodispersion emulsion is preferable.

Emulsions prepared from these silver halides may be chemically sensitized with suitable materials such as activated gelatin, sulfur sensitizers, selenium sensitizers, reduction sensitizers and noble metal sensitizers. The silver halides described above may be optically sensitized by addition of suitable sensitizing dyes in order to impart sensitivity to desired wavelength ranges of sensitivity.

The silver halide photographic material of the present invention may contain any suitable additive such as a color fog preventing agent, an image stabilizer, a hardening agent, a plasticizer, a polymer latex, a uv absorber, a formaldehyde scavenger, a mordant, a development accelerator, a developer retarder, a brightener, a matting agent, a lubricant, an antistat, and a surfactant.

The silver halide photographic material of the present invention may be processed by a variety of color developing processes. While various developing solutions may be employed, the advantages of the present invention are especially noticeable when development is conducted with a developing solution that contains no benzyl alcohol.

In accordance with the present invention, the cyan coupler of the present invention is used in combination with the non-color forming compound of the present invention so as to provide a silver halide photographic material capable of producing a cyan dye image that not only exhibits better keeping quality but also ensures improved color reproduction because the maximum absorption peak of the cyan dye is shifted to the longer-wavelength side of the spectrum. It is also possible for the present invention to provide a silver halide photographic material that produces a dye image having a sufficient color density to attain a desired high maximum value.

The following examples are provided for the purpose of further illustrating the present invention but are in no way to be taken as limiting its scope.

EXAMPLE 1

Preparation of Silver Halide Emulsions

Six silver halide emulsions having the characteristics shown in Table 1 below were prepared by the neutral method and the double-jet method.

TABLE 1

| Emulsion No. | AgCl, % | AgBr, % | Average grain size, μ | Chemical sensitizer | Spectral sensitizing dye |
|---|---|---|---|---|---|
| Em-1 | 99.5 | 0.5 | 0.67 | Sodium thiosulfate*1 | SD-1*3 |
| Em-2 | 99.5 | 0.5 | 0.46 | | SD-2*4 |
| Em-3 | 99.5 | 0.5 | 0.43 | Chloroauric acid*2 | SD-3*5 |
| Em-4 | 10 | 90 | 0.67 | Sodium thiosulfate*1 | SD-1*3 |
| Em-5 | 30 | 70 | 0.46 | | SD-2*4 |
| Em-6 | 30 | 70 | 0.43 | | SD-3*5 |

*1added in an amount of 2 mg per mole of silver halide;
*2added in an amount of $5 \times 10^{-5}$ moles per mole of silver halide;
*3added in an amount of 0.9 mmol per mole of silver halide;
*4added in an amount of 0.7 mmol per mole of silver halide;
*5added in an amount of 0.2 mmol per mole of silver halide.

After chemical sensitization of the silver halide emulsions, STB-1 having the structure shown below was added as an emulsion stabilizer in an amount of $5\times10^{-3}$ moles per mole of silver halide.

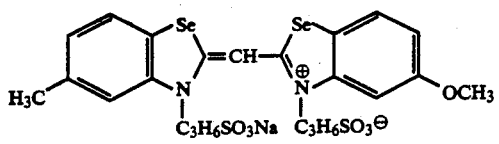

(SD-1)

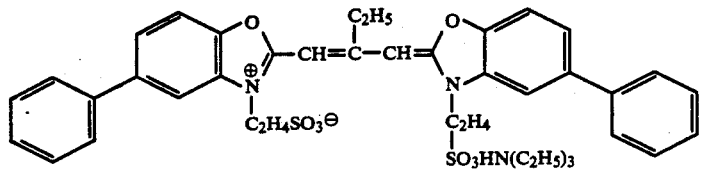

(SD-2)

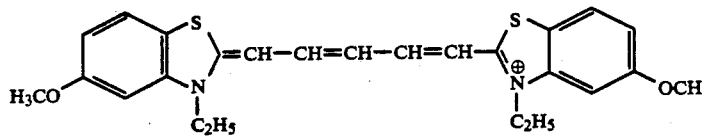

(SD-3)

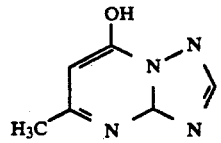

(STB-1)

Preparation of samples of silver halide color photographic material:

Using emulsions, Em-1 to Em-3, samples of silver halide color photographic material (Nos. 1–76) were prepared by coating the following layers 1 to 7 in superposition on a paper support that had been coated with polyethylene on both sides. In Example 1 and subsequent examples, all amounts of addition are expressed in terms of deposit weights per square meter of sensitive material unless otherwise indicated.

Layer 1: layer containing 1.2 g of gelatin, 0.29 g (in terms of silver, as in the other layers) of blue-sensitive silver halide emulsion (Em-1) 0.75 g of yellow coupler (Y-1), 0.3 g of light stabilizer (ST-1), and 0.3 g of dinonyl phthalate (DNP) having 0.015 g of 2,5-dioctylhydroquinone (HQ-1) dissolved therein;

Layer 2: layer containing 0.9 g of gelatin and 0.2 g of DOP (dioctyl phthalate) having 0.04 g of HQ-1 dissolved therein;

Layer 3: layer containing 1.4 g of gelatin, 0.2 g of green-sensitive silver halide emulsion (Em-2), 0.50 g of magenta coupler (M-1), 0.25 g of light stabilizer (ST-2), 0.3 g of DOP having 0.01 g of HQ-1 dissolved therein, and 6 mg of a filter dye (AI-1, see below);

Layer 4: layer containing 1.2 g of gelatin, 0.6 g of a uv absorber (UV-1, see below), and 0.3 g of DNP having 0.05 g of HQ-1 dissolved therein;

Layer 5: layer containing 1.4 g of gelatin, 0.20 g of red-sensitive silver halide emulsion (Em-3), and 0.3 g of DOP having dissolved therein 0.9 mmol of cyan coupler (see Table 2), 0.3 g of a non-color forming compound of the present invention (see Table 2), and 0.01 g of HQ-1;

Layer 6: layer containing 1.1 g of gelatin, 0.2 g of DOP having 0.2 g of UV-1 dissolved therein, and 5 mg of filter dye (AI-2, see below); and Layer 7: layer containing 1.0 g of gelatin and 0.05 g of 2,4-di-chloro-6-hydroxytriazine sodium.

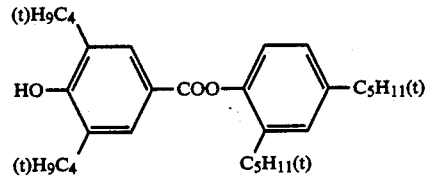

(ST-1)

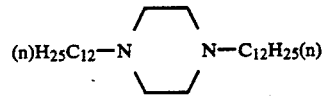

(ST-2)

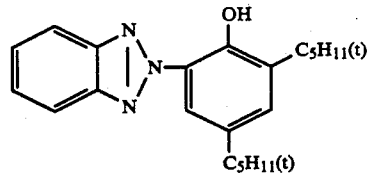

(UV-1)

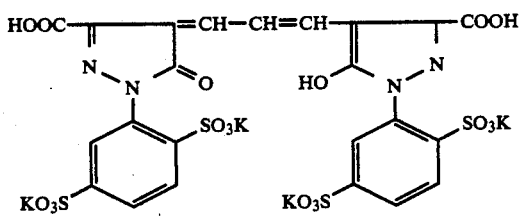

(AI-1)

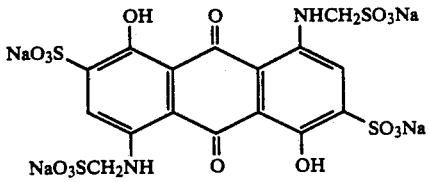

(AI-2)

-continued (Y-1)

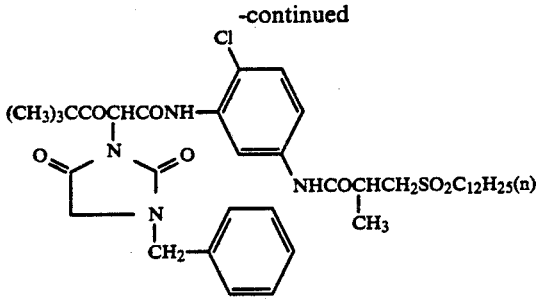

(M-1)

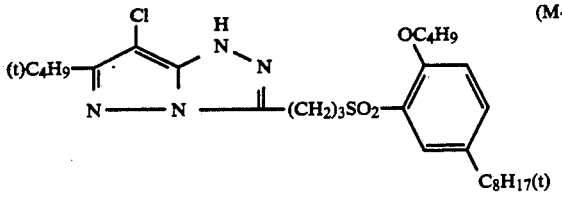

The photographic samples thus prepared were exposed to light through an optical wedge using a sensitometer Model KS-7 of Konishiroku Photo Industry Co., Ltd., and subsequently processed in accordance with the scheme shown below. Thereafter, the maximum density (Dmax) of the red-sensitive emulsion layer in each of the processed samples was measured with an optical densitometer Model PDA-65 of Konishiroku Photo Industry Co., Ltd.

Maximum absorption peak (λmax) for a cyan dye image density of 1.0, as well as the blue and green densities ($D_B$ and $D_G$) at 420 and 550 nm, respectively, were also measured.

The samples were stored for 20 days at 85° C. and at 60% relative humidity and their resistance to fading in the dark was evaluated by determining the residual percentage of the cyan dye image for an initial density of 1.0 according to the following formula:

$$\text{Residual dye image (\%)} = \frac{\text{density after storage}}{\text{initial density}} \times 100.$$

The results are shown in Table 2.

| Processing scheme: | | |
|---|---|---|
| Steps | Temperature (°C.) | Time (sec) |
| Color development | 34.7 ± 0.3 | 45 |
| Bleach-fixing | 34.7 ± 0.5 | 50 |
| Stabilizing | 30~34 | 90 |
| Drying | 60~80 | 60 |

| | |
|---|---|
| Color developer | |
| Pure water | 800 ml |
| Triethanolamine | 8 g |
| N,N-diethylhydroxyamine | 5 g |
| Potassium chloride | 2 g |
| N-ethyl-N-β-methanesulfonamidoethyl-3-methyl-4-aminoaniline sulfate | 5 g |
| Sodium tetrapolyphosphate | 2 g |
| Potassium carbonate | 30 g |
| Potassium sulfite | 0.2 g |
| Brightener (4,4'-diaminostilbene disulfonic acid derivative) | 1 g |
| Water | to make 1,000 ml |
| pH | adjusted to 10.2 |
| Bleach-fixing solution | |
| Ethylenediaminetetraacetic acid iron (II) ammonium dihydrate | 60 g |
| Ethylenediaminetetraacetic acid | 3 g |
| Ammonium thiosulfate (70% aq. sol.) | 100 ml |
| Ammonium sulfite (40% aq. sol.) | 27.5 ml |
| Potassium carbonate or glacial acetic acid to adjust pH to | 5.7 |
| Water | to make 1,000 ml |
| Stabilizing solution: | |
| 5-chloro-2-methyl-4-isothiazolin-3-one | 1 g |
| 1-hydroxyethylidene-1,1-diphosphonic acid | 2 g |
| Water | to make 1,000 ml |
| Sulfuric acid or potassium hydroxide to adjust pH to | 7.0 |

TABLE 2

| Sample No. | Cyan coupler | Non-color forming compound | Dmax | λmax | $D_G$ | $D_B$ | Resistance to fading in the dark | Remarks |
|---|---|---|---|---|---|---|---|---|
| 1 | CC-1 | — | 2.75 | 652 | 0.465 | 0.435 | 39 | comparative |
| 2 | CC-2 | — | 2.43 | 656 | 0.458 | 0.446 | 73 | samples |
| 3 | C-2 | — | 2.12 | 649 | 0.508 | 0.361 | 98 | |
| 4 | C-18 | — | 2.27 | 648 | 0.507 | 0.358 | 99 | |
| 5 | C-23 | — | 2.34 | 649 | 0.510 | 0.363 | 99 | |
| 6 | C-24 | — | 2.10 | 648 | 0.512 | 0.360 | 98 | |
| 7 | CC-1 | A-32 | 2.78 | 653 | 0.464 | 0.438 | 38 | |
| 8 | CC-2 | A-32 | 2.68 | 656 | 0.459 | 0.447 | 74 | |
| 9 | C-2 | A-32 | 2.59 | 656 | 0.460 | 0.362 | 98 | samples |
| 10 | C-18 | A-32 | 2.65 | 655 | 0.460 | 0.360 | 98 | of the |
| 11 | C-23 | A-32 | 2.71 | 656 | 0.461 | 0.355 | 99 | invention |
| 12 | C-24 | A-32 | 2.58 | 655 | 0.467 | 0.360 | 98 | |
| 13 | C-5 | A-32 | 2.75 | 655 | 0.461 | 0.363 | 98 | |
| 14 | C-7 | A-32 | 2.56 | 656 | 0.459 | 0.358 | 99 | |
| 15 | C-10 | A-32 | 2.64 | 654 | 0.468 | 0.364 | 98 | |
| 16 | C-17 | A-32 | 2.66 | 656 | 0.458 | 0.361 | 99 | |
| 17 | C-2 | A-1 | 2.61 | 656 | 0.459 | 0.363 | 98 | |
| 18 | C-2 | A-2 | 2.57 | 657 | 0.456 | 0.368 | 98 | |
| 19 | C-2 | A-15 | 2.60 | 656 | 0.458 | 0.361 | 99 | |
| 20 | C-2 | A-18 | 2.64 | 655 | 0.460 | 0.368 | 99 | |
| 21 | C-2 | A-30 | 2.56 | 653 | 0.482 | 0.355 | 98 | |
| 22 | C-2 | A-35 | 2.53 | 652 | 0.485 | 0.357 | 97 | |
| 23 | C-2 | A-38 | 2.61 | 657 | 0.457 | 0.364 | 99 | |
| 24 | C-2 | A-40 | 2.63 | 657 | 0.456 | 0.360 | 98 | |
| 25 | C-2 | A-52 | 2.57 | 654 | 0.467 | 0.362 | 99 | |
| 26 | C-2 | A-53 | 2.63 | 654 | 0.466 | 0.363 | 98 | |
| 27 | C-2 | A-56 | 2.64 | 653 | 0.470 | 0.364 | 99 | |
| 28 | C-2 | A-59 | 2.51 | 652 | 0.484 | 0.363 | 98 | |
| 29 | C-2 | A-60 | 2.54 | 653 | 0.470 | 0.361 | 99 | |
| 30 | C-2 | A-61 | 2.58 | 652 | 0.481 | 0.364 | 99 | |

TABLE 2-continued

| Sample No. | Cyan coupler | Non-color forming compound | Dmax | λmax | $D_G$ | $D_B$ | Resistance to fading in the dark | Remarks |
|---|---|---|---|---|---|---|---|---|
| 31 | C-2 | A-62 | 2.57 | 654 | 0.471 | 0.358 | 98 | |
| 32 | C-2 | A-63 | 2.56 | 653 | 0.472 | 0.359 | 99 | |
| 33 | C-2 | A-68 | 2.52 | 653 | 0.479 | 0.356 | 98 | |
| 34 | C-2 | A-69 | 2.55 | 653 | 0.481 | 0.360 | 98 | |
| 35 | C-2 | A-70 | 2.53 | 652 | 0.483 | 0.357 | 98 | |
| 36 | C-2 | A-83 | 2.54 | 653 | 0.474 | 0.372 | 99 | |
| 37 | C-2 | A-84 | 2.61 | 655 | 0.463 | 0.364 | 99 | |
| 38 | C-2 | A-86 | 2.51 | 653 | 0.471 | 0.360 | 98 | |
| 39 | C-2 | A-87 | 2.54 | 654 | 0.468 | 0.357 | 99 | |
| 40 | C-2 | A-76 | 2.66 | 656 | 0.459 | 0.366 | 98 | |
| 41 | C-2 | A-72 | 2.62 | 657 | 0.458 | 0.361 | 98 | |
| 42 | C-2 | A-80 | 2.54 | 655 | 0.470 | 0.353 | 99 | |
| 43 | C-2 + CC-1*1 | — | 2.32 | 650 | 0.498 | 0.384 | 76 | comparative sample |
| 44 | C-2 + CC-1*1 | A-32 | 2.75 | 656 | 0.456 | 0.386 | 75 | samples |
| 45 | C-2 + CC-1*1 | A-1 | 2.70 | 657 | 0.454 | 0.384 | 77 | of the |
| 46 | C-2 + CC-1*1 | A-18 | 2.78 | 656 | 0.458 | 0.382 | 78 | invention |
| 47 | C-2 + CC-1*1 | A-40 | 2.75 | 657 | 0.454 | 0.388 | 76 | |
| 48 | C-2 + CC-1*1 | A-52 | 2.68 | 654 | 0.463 | 0.384 | 77 | |
| 49 | C-2 + CC-1*1 | A-61 | 2.70 | 653 | 0.476 | 0.388 | 75 | |
| 50 | C-2 + CC-1*1 | A-84 | 2.76 | 656 | 0.459 | 0.382 | 74 | |
| 51 | C-2 + CC-1*1 | A-72 | 2.75 | 657 | 0.456 | 0.379 | 76 | |
| 52 | C-2 + CC-1*1 | A-17 | 2.74 | 657 | 0.456 | 0.381 | 77 | |
| 53 | C-2 + CC-1*1 | A-33 | 2.73 | 657 | 0.459 | 0.382 | 78 | |
| 54 | C-2 + CC-1*1 | A-39 | 2.68 | 656 | 0.457 | 0.386 | 75 | |
| 55 | C-2 + CC-1*1 | A-41 | 2.71 | 656 | 0.457 | 0.379 | 78 | |
| 56 | C-2 + CC-1*1 | A-42 | 2.73 | 656 | 0.458 | 0.382 | 75 | |
| 57 | C-2 + CC-1*1 | A-44 | 2.69 | 658 | 0.455 | 0.386 | 76 | |
| 58 | C-2 + CC-1*1 | A-47 | 2.78 | 657 | 0.457 | 0.381 | 77 | |
| 59 | C-2 + CC-1*1 | A-75 | 2.72 | 656 | 0.457 | 0.386 | 75 | |
| 60 | C-18 + CC-1*2 | A-32 | 2.86 | 655 | 0.457 | 0.383 | 78 | |
| 61 | C-2 + CC-2*3 | A-32 | 2.70 | 657 | 0.454 | 0.390 | 88 | |
| 62 | C-18 + CC-2*4 | A-32 | 2.80 | 656 | 0.454 | 0.389 | 90 | |

*1C-2:CC-1 = 0.6:0.4 (by molar ratio)
*2C-18:CC-1 = 0.6:0.4 (by molar ratio)
*3C-2:CC-2 = 0.6:0.4 (by molar ratio)
*4C-18:CC-2 = 0.6:0.4 (by molar ratio)

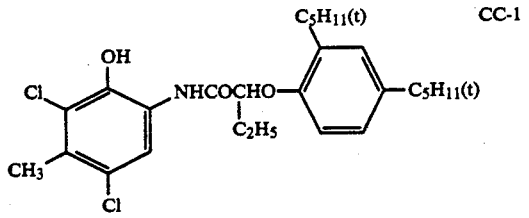

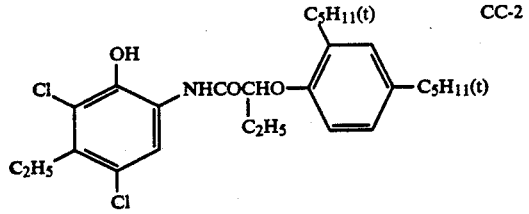

As Table 2 shows, sample Nos. 1 and 7 using a conventional cyan coupler had high values of Dmax and λmax and low values of $D_G$ but they were not suitable for use in practical applications because their resistance to fading in the dark was very low. In addition, these samples had too large values of $D_B$ to ensure good reproduction of a blue color. Sample Nos. 2 and 8 that employed a phenolic cyan coupler having an ethyl group at the 5-position were appreciably improved in their resistance to fading in the dark but they also had too large values of $D_B$ to ensure good reproduction of a blue color. Sample No. 2 was also undesired because of its comparatively low Dmax. Sample Nos. 3 to 6 which employed cyan couplers of the present invention uncombined with the non-color forming compound of the present invention were very high in resistance to fading in the dark but they had low values of Dmax and λmas while offering too large values of $D_G$ to achieve satisfactory reproduction of a green color. Sample No. 43 which employed a cyan coupler of the present invention is combination with a cyan coupler outside the scope of the present invention had an insufficient value of Dmax. Furthermore, its λmax was small and the reduction in $D_G$ was far from being satisfactory. Sample Nos. 9–42 which employed cyan couplers of the present invention in combination with non-color forming compounds of formula (II) had high values of Dmax (≧2.5) and λmax but their $D_G$ and $D_B$ values were sufficiently small to achieve good reproduction of green and blue colors. In addition, these samples of silver halide photographic material offered a very high level of resistance to fading in the dark.

Sample Nos. 44–62 of the present invention employed two cyan couplers, one being within the scope of the present invention and the other being outside the scope of the present invention, in combination with non-color forming compounds of the present invention. The Dmax values of these samples were even higher than those of sample Nos. 9–42. They had high λmax values and yet offered sufficiently small $D_G$ and $D_B$ values to achieve good reproduction of green and blue colors. In addition, these samples proved to be more resistant to fading in the dark than sample No. 2.

Sample Nos. 9 and 17–42 employed the same cyan coupler, C-2. Among these samples, sample Nos. 9, 17–20, 23–27, 37 and 40–42 which employed non-color forming compounds of formula (IV) were particularly good since they produced high maximum densities, had maximum absorption peaks of cyan dyes sufficiently shifted to the longer-wavelength side of the spectrum, and offered low $D_G$ values. The same observation was obtained from the comparison of sample Nos. 44–59 that employed C-2 in combination with CC-1 which was a cyan coupler outside the scope of the present invention. Those samples which employed non-color forming compounds of formula (IV) were particularly good since they had maximum absorption peaks of cyan dyes at the longer-wavelength side of the spectrum while offering small $D_G$ values.

It is therefore clear that only when the cyan coupler of the present invention is combined with the non-color forming compound of the present invention, a silver halide photographic material can be attained that produces a dye image having a high maximum density and good keeping quality and offering satisfactory color reproduction.

EXAMPLE 2

Sample Nos. 63–84 of silver halide color photographic material were prepared as in Example 1 except that Em-1, Em-2 and Em-3 in layers 1, 3 and 5 were replaced by Em-4, Em-5 and Em-6, respectively, and that the cyan coupler(s) and non-color forming compound shown in Table 3 were incorporated in layer 5.

The resulting samples were exposed to light through an optical wedge using a sensitometer Model KS-7 of Konishiroku Photo Industry Co., Ltd., and subsequently processed in accordance with the scheme shown below. Thereafter, the processed samples were subjected to the same measurements as conducted in Example 1. The results are shown in Table 3.

| Processing scheme: | | |
|---|---|---|
| Steps | Temperature (°C.) | Time |
| Color development | 33 | 3 min and 30 sec |
| Bleach-fixing | 33 | 1 min and 30 sec |
| Washing | 33 | 3 min |

Color developer

-continued

| Processing scheme: | |
|---|---|
| N-ethyl-N-β-methane-sulfonamidoethyl-3-methyl-4-amino-aniline sulfate | 4.9 g |
| Hydroxylamine sulfate | 2.0 g |
| Potassium carbonate | 25.0 g |
| Sodium bromide | 0.6 g |
| Anhydrous sodium sulfite | 2.0 g |
| Benzyl alcohol | 13 ml |
| Polyethylene glycol (average mol. wt., 400) | 3.0 ml |
| Water | to make 1,000 ml |
| Sodium hydroxide to adjust pH | to 10.0 |
| Bleach-fixing solution | |
| Ethylenediaminetetraacetic acid iron sodium salt | 6.0 g |
| Ammonium thiosulfate | 100 g |
| Sodium bisulfite | 10 g |
| Sodium metabisulfite | 3 g |
| Water | to make 1,000 ml |
| Aqueous ammonia to adjust pH | to 7.0 |

TABLE 3

| Sample No. | Cyan coupler | Non-color forming compound | Dmax | λmax, nm | $D_G$ | $D_B$ | Resistance to fading in the dark | Remarks |
|---|---|---|---|---|---|---|---|---|
| 63 | CC-1 | — | 2.82 | 652 | 0.482 | 0.438 | 42 | comparative |
| 64 | CC-2 | — | 2.65 | 656 | 0.477 | 0.450 | 75 | samples |
| 65 | C-2 | — | 2.42 | 649 | 0.521 | 0.363 | 98 | |
| 66 | CC-1 | A-72 | 2.84 | 653 | 0.480 | 0.440 | 41 | |
| 67 | CC-2 | A-72 | 2:77 | 656 | 0.476 | 0.449 | 74 | |
| 68 | C-2 | A-72 | 2.68 | 656 | 0.480 | 0.362 | 99 | samples |
| 69 | C-3 | A-72 | 2.66 | 655 | 0.482 | 0.364 | 99 | of the |
| 70 | C-18 | A-72 | 2.74 | 655 | 0.479 | 0.364 | 98 | invention |
| 71 | C-19 | A-72 | 2.81 | 655 | 0.480 | 0.362 | 99 | |
| 72 | C-24 | A-72 | 2.68 | 655 | 0.485 | 0.359 | 98 | |
| 73 | C-2 | A-1 | 2.70 | 656 | 0.480 | 0.358 | 98 | |
| 74 | C-2 | A-28 | 2.75 | 658 | 0.475 | 0.368 | 99 | |
| 75 | C-2 | A-32 | 2.72 | 657 | 0.476 | 0.362 | 99 | |
| 76 | C-2 + CC-1*1 | A-72 | 2.78 | 656 | 0.477 | 0.382 | 78 | |
| 77 | C-2 + CC-1*1 | A-2 | 2.76 | 657 | 0.476 | 0.387 | 79 | |
| 78 | C-2 + CC-1*1 | A-18 | 2.82 | 656 | 0.478 | 0.385 | 79 | |
| 79 | C-2 + CC-1*1 | A-40 | 2.77 | 656 | 0.476 | 0.387 | 77 | |
| 80 | C-2 + CC-1*1 | A-55 | 2.76 | 654 | 0.488 | 0.385 | 77 | |
| 81 | C-2 + CC-1*1 | A-88 | 2.74 | 654 | 0.485 | 0.382 | 77 | |
| 82 | C-18 + CC-1*2 | A-72 | 2.82 | 656 | 0.476 | 0.385 | 78 | |
| 83 | C-2 + CC-2*3 | A-72 | 2.75 | 657 | 0.475 | 0.392 | 90 | |
| 84 | C-18 + CC-2*4 | A-72 | 2.80 | 656 | 0.475 | 0.390 | 91 | |

*1–*4See the footnotes to Table 2.

As is clear from Table 3, sample Nos. 68–71 of the present invention achieved satisfactorily high levels of Dmax and high values of λmax, as well as offering sufficiently small values of $D_G$ and $D_B$ to ensure good reproduction of green and blue colors. In addition, these samples offered very high levels of resistance to fading in the dark.

The developing solution used in Example 2 was of a common type that contained benzyl alcohol as an accelerator of color formation.

The above results show that the combination of the cyan coupler and the non-color forming compound of the present invention is also effective in development with such a benzyl alcohol containing developer.

EXAMPLE 3

To 6 g of a cyan coupler (see Table 4), 3 g of a non-color forming compound (also see Table 4) and 3 g of dibutyl phthalate were added. After addition of 18 g of ethyl acetate, the resulting mixture was heated at 60° C. to form a solution. This solution was mixed with 100 ml of an aqueous solution of 5% gelatin that contained 10 ml of an aqueous solution of 5% Alkanol B (the trade name of Du Pont for an alkylnaphthalenesulfonate). The mixture was emulsified with an ultrasonic disperser to prepare a dispersion.

This dispersion was added to a silver iodobromide emulsion (containing 6 mol % AgI) in such an amount that the content of the cyan coupler would be 10 mol % of silver. Thereafter, 1,2-bis(vinylsulfonyl)ethane was added as a hardener in an amount of 12 mg per gram of gelatin. The so prepared coating solution was applied to a subbed transparent triacetyl cellulose film base so as to provide a silver deposit of 18 mg/100 $cm^2$. The resulting silver halide photographic materials were wedge-exposed by a conventional method and subsequently processed by the following scheme.

| Steps | Processing scheme: Temperature (°C.) | Time |
|---|---|---|
| Color development | 38 | 3 min and 15 sec |
| Bleaching | 38 | 6 min and 30 sec |
| Washing | 38 | 3 min and 15 sec |
| Fixing | 38 | 6 min and 30 sec |
| Washing | 38 | 3 min and 15 sec |
| Stabilizing | 38 | 1 min and 30 sec |

The processing solutions employed had the following formulations.

| | |
|---|---|
| Color developer | |
| 4-amino-3-methyl-N-ethyl-N-(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Water | to make 1,000 ml |
| Potassium hydroxide to adjust pH | to 10.0 |
| Bleaching solution | |
| Ethylenediaminetriacetic acid iron ammonium salt | 100 g |
| Ethylenediaminetetraacetic acid diammonium salt | 10 g |
| Ammonium bromide | 150 g |
| Glacial acetic acid | 10 ml |
| Water | to make 1,000 ml |
| Aqueous ammonia to adjust pH | to 6.0 |
| Fixing solution | |
| Ammonium thiosulfate (50% aq. sol.) | 162 ml |
| Anhydrous sodium sulfite | 12.4 g |
| Water | to make 1,000 ml |
| Acetic acid to adjust pH | to 6.5 |
| Stabilizing solution | |
| Formaldehyde (37% aq. sol.) | 5.0 ml |
| Konidax (product of Konishiroku Photo Industry Co., Ltd.) | 7.5 ml |
| Water | to make 1,000 ml |

The so processed samples of silver halide photographic material were subjected to measurements of the maximum absorption peak (λmax) for a cyan dye image density of 1.0 and the maximum density (Dmax) of cyan dye image. The results are shown in Table 4.

TABLE 4

| Sample No. | Cyan coupler | Non-color forming compound | Dmax | λmax, nm | Remarks |
|---|---|---|---|---|---|
| 85 | C-26 | — | 2.27 | 690 | comparative sample |
| 86 | C-26 | A-2 | 2.56 | 696 | sample of the invention |
| 87 | C-26 | A-40 | 2.54 | 697 | sample of the invention |
| 88 | C-27 | — | 2.19 | 689 | comparative sample |
| 89 | C-27 | A-58 | 2.55 | 695 | sample of the invention |
| 90 | C-28 | — | 2.20 | 689 | comparative sample |
| 91 | C-28 | A-32 | 2.54 | 696 | sample of the invention |
| 92 | C-29 | — | 2.28 | 690 | comparative sample |
| 93 | C-29 | A-44 | 2.56 | 697 | sample of the invention |
| 94 | C-31 | — | 2.43 | 689 | comparative sample |
| 95 | C-31 | A-72 | 2.62 | 695 | sample of the invention |

All of the samples tested in Example 3 employed phenolic cyan couplers containing a ureido group but comparative sample Nos. 85, 88, 90, 92 and 94 did not employ any of the non-color forming compounds of the present invention. In comparison, sample Nos. 86, 87, 89, 91, 93 and 95 containing non-color forming compounds within the scope of the present invention attained high maximum densities (Dmax) and had the maximum absorption peaks of cyan dye (λmax) shifted sufficiently to the longer-wavelength side of the spectrum to be appropriate for use as imaging negative light-sensitive materials that would ensure improved color reproduction.

What is claimed is:

1. A silver halide photographic material that has one or more silver halide emulsion layers on a support, wherein at least one of said silver halide emulsion layers contains at least one cyan coupler represented by the following general formula (I):

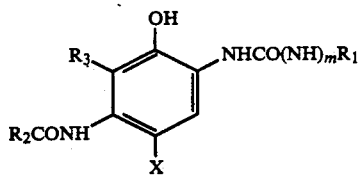

(I)

where $R_1$ and $R_2$ are each an alkyl group, a cycloalkyl group, an alkenyl group, an aryl group or a heterocyclic group; $R_3$ is a hydrogen atom, a halogen atom, an alkyl group or an alkoxy group, provided that $R_2$ and $R_3$ may cooperate to form a ring; X is a hydrogen atom or a group that is capable of being eliminated upon reaction with the oxidation product of a color developing agent; and m is 0 or 1;

and at least one non-color forming compound selected from the group consisting of the following compounds:

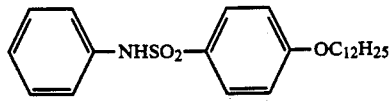

(1)

-continued (2)

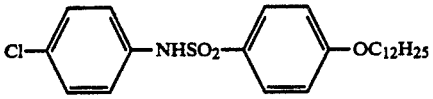

(3)

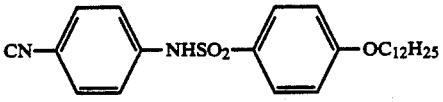

(4)

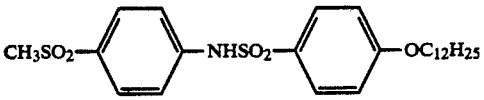

(5)

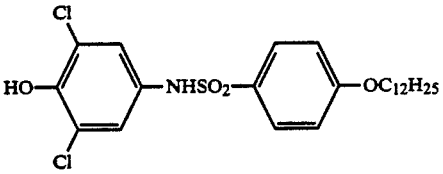

(6)

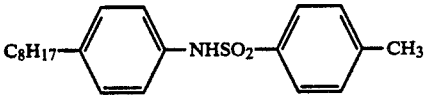

(7)

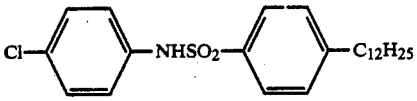

(8)

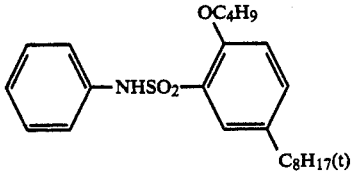

(9)

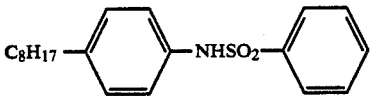

(10)

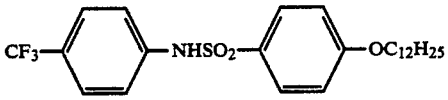

(11)

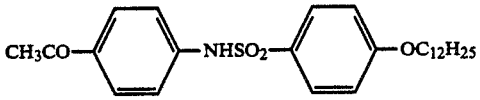

-continued (12)

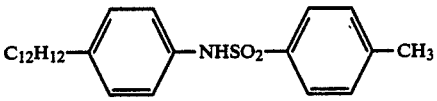

(13)

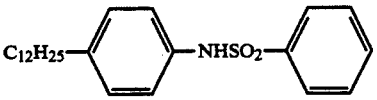

2. The silver halide photographic material of claim 1, wherein said non-color forming compound is:

(10)

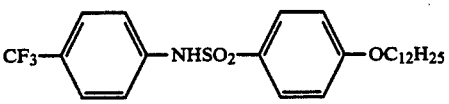

3. The silver halide photographic material of claim 1, wherein said non-color forming compound is:

(5)

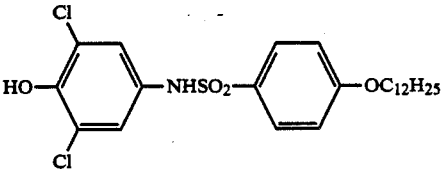

4. A silver halide photographic material that has one or more silver halide emulsion layers on a support, wherein at least one of said silver halide emulsion layers contains at least one cyan coupler represented by the following general formula (I) and at least one non-color forming compound represented by the following formula (IV):

(I)

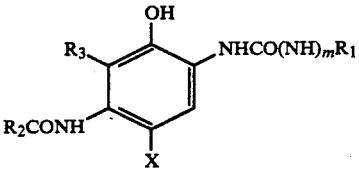

wherein $R_1$ and $R_2$ are each an alkyl group, a cycloalkyl group, an alkenyl group, an aryl group or a heterocyclic group; $R_3$ is a hydrogen atom, a halogen atom, an alkyl group or an alkoxy group, provided that $R_2$ and $R_3$ may cooperate to form a ring; X is a hydrogen atom or a group that is capable of being eliminated upon reaction with the oxidation product of a color developing agent; and m is 0 or 1;

$$R_{11}—NHSO_2—R_{12} \qquad \text{(IV)}$$

wherein both $R_{11}$ and $R_{12}$ are an alkyl group.

* * * * *

UNITED STATES PATENT AND TRADEMARK OFFICE

CERTIFICATE OF CORRECTION

PATENT NO. : 5,019,493

DATED : May 28, 1991

INVENTOR(S) : Hirokazu Sato et al.

It is certified that error appears in the above-indentified patent and that said Letters Patent is hereby corrected as shown below:

Claim 1, at the top of column 44, compound (12), "$C_{12}H_{12}$" should read --$C_{12}H_{25}$--.

Abstract, line 5, change "in" to --is--.

Signed and Sealed this

Twenty-fourth Day of January, 1995

*Attest:*

Bruce Lehman

BRUCE LEHMAN

*Attesting Officer*

*Commissioner of Patents and Trademarks*